United States Patent [19]

Greene

[11] Patent Number: 5,031,917

[45] Date of Patent: Jul. 16, 1991

[54] THREE DIMENSIONAL CHESS GAME

[76] Inventor: Leonard M. Greene, 6 Hickory La., Scarsdale, N.Y. 10602

[21] Appl. No.: 585,817

[22] Filed: Sep. 20, 1990

[51] Int. Cl.[5] ..... A63F 3/02

[52] U.S. Cl. ..... 273/241; 273/261; D21/23

[58] Field of Search ..... 273/241, 261, 260; D21/23, 24

[56] References Cited

U.S. PATENT DOCUMENTS 3,610,626 10/1971 Nolte ..... 273/261
3,767,201 10/1973 Harper et al. ..... 273/241

FOREIGN PATENT DOCUMENTS 2838140 3/1980 Fed. Rep. of Germany ..... 273/241
1283840 2/1972 United Kingdom ..... 273/241

OTHER PUBLICATIONS

"3-Dimensional Space Chess" House Beautiful advertisement, Nov. 1967, p. 214.
"Space Chess" Sears advertisement.
"The $100,000 Gambit:Making Chess a Play Object by Frank Brady", Games Magazine, Jan.-Feb. 1981, pp. 18-20.
"Three-Dimensional Chess" Chess Variations by John Gollon, pp. 228-229.

*Primary Examiner*—Benjamin Layno
*Attorney, Agent, or Firm*—Edward A. Sokolski

[57] ABSTRACT

A Chess game has eight similar conventional 64 square chess boards. The boards can be stacked vertically, one above the other or can be laid out flat, one adjacent to the other. One set of chessmen is initially arranged in normal fashion on one side of the topmost board while the other set of chessman is arranged in normal fashion on the lowermost board on the side thereof opposite to that one which the first set is arranged. A second row of pawns is provided for each set, one of which is arranged in the first row of the board directly below the topmost board and the other of which is arranged in the first row of the board directly above the lowermost board. The pieces are moved as in a regular game of chess except that moves can be made both vertically and horizontally with the proviso that a piece cannot be moved both fore or aft and up or down in the same move.

6 Claims, 2 Drawing Sheets

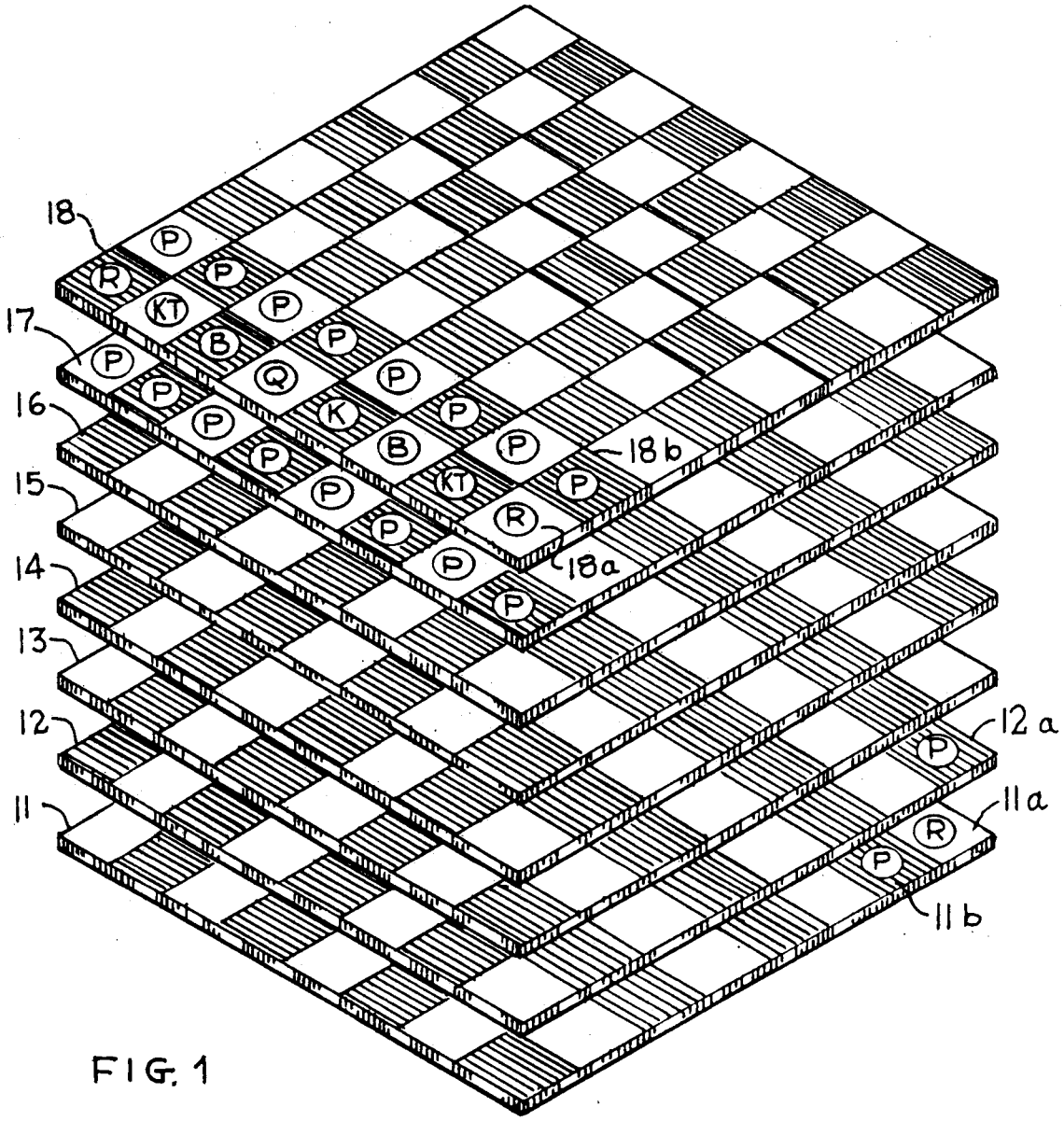
FIG. 1
FIG. 3
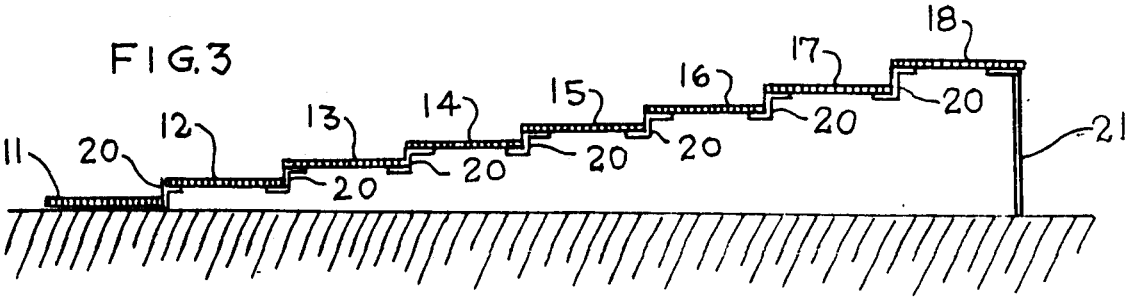

THREE DIMENSIONAL CHESS GAME

BACKGROUND OF THE INVENTION

1. Field of the Invention

This invention relates to board games and more particularly to a game of chess employing eight similar checkered boards wherein the pieces can be moved either horizontally on the same board or vertically between boards.

2. Description of the Related Art

Multi-tiered chess and other board games have been developed in the prior art wherein boards are stacked one above the other with the pieces being movable either on the same board or between boards. Two tier chess games are described in U.S. Pat. No. 3,937,471 to Brennan and U.S. Pat. No. 1,877,154 to Weaver. A four tier chess game with 16 squares on each board is described in U.S. Pat. No. 3,684,285 to Kane. U.S. Pat. No. 3,399,895 describes a three tier checker game. U.S. Pat. No. 3,767,201 describes a multi-tier chess and checker game in which the stacked boards each has a different number of squares. None of the above games employs a fully "cubical" set of boards in which the normal 64 square horizontal board is duplicated so that there are eight similar boards, with the pieces being arranged in diagonally opposite corners of the set of boards.

BRIEF SUMMARY OF THE INVENTION

Eight similar conventional chessboards are either arranged vertically, one above the other or laid out flat adjacent to each other. A first set of chess pieces for one player is arranged in conventional fashion on one side of the topmost board (or the board representing the topmost board where the boards are laid out flat). A second set of chess pieces for the other player is arranged in conventional fashion on the opposite side of the lowermost board(or the board representing such lowermost board where the boards are laid out flat). A second complete set of eight pawns is provided for each set of pieces, the pawns for the first set being arranged in the first row of the board immediately below the topmost board, the pawns for the second set being arranged in the first row of the board immediately above the lowermost board, the pawns thus being arranged as the case may be either directly above or directly below the "king's" row of pieces. In playing the game, pieces can be moved either horizontally on the same board or between boards, provided that in any one move a piece cannot be moved both up or down and fore or aft.

BRIEF DESCRIPTION OF THE DRAWINGS

FIG. 1 is a perspective view of a first embodiment of the invention in which the boards are tiered;

FIG. 3 is a side elevational view of a third embodiment of the invention.

DETAILED DESCRIPTION OF THE INVENTION

Figure 2:
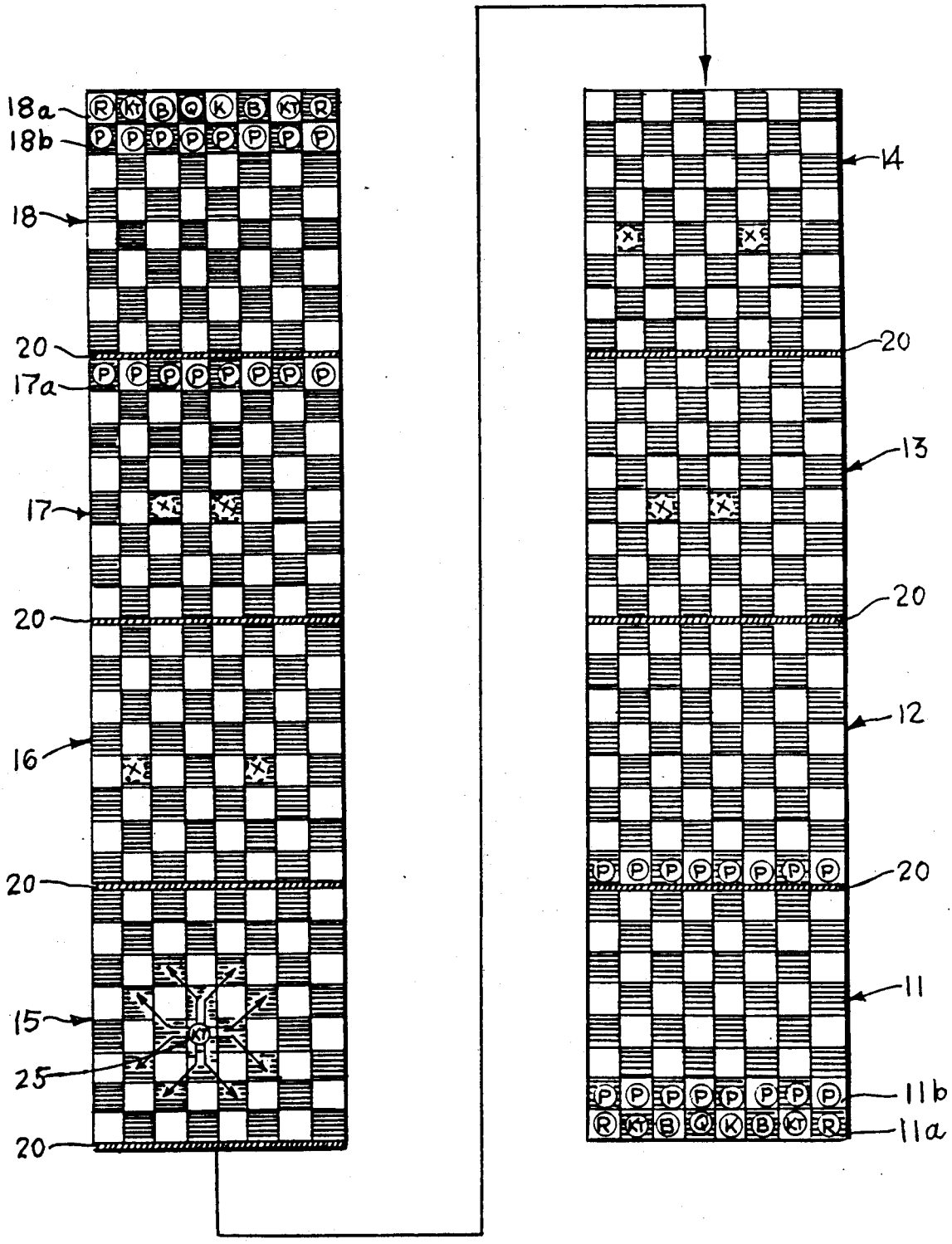
FIG. 2 is a top plan view of a second embodiment of the invention in which the boards are laid flat adjacent to each other

Referring to FIG. 1, a first embodiment of the invention is illustrated. In this first embodiment, a plurality of conventional chessboards 11–18 are stacked one above the other in tiers. The boards are arranged so that the corresponding corner squares of adjacent boards have opposite colors. The separation between adjacent boards is made great enough to enable the players to move the pieces thereon. The chess pieces for one side are arranged in conventional fashion in the first and second left hand rows 18*a* and 18*b* of board 18 while the pieces for the opposite side are arranged in conventional fashion in first and second right hand rows 11*a* and 11*b* of board 11. A second row of pawns is arranged for each side in the first left hand row 17*a* of board 17 and first right hand row 12*a* of board 12 respectively for the same basic purpose as the first rows of pawns, i.e. to protect the kings row pieces.

Referring now to FIG. 2, a second embodiment of the invention is shown. This embodiment differs from the first in that the boards 11–18 rather than being stacked in tiers are rather placed adjacent to each other. The boards can either be placed in a fore-aft arrangement (as shown) or can be arranged laterally, i.e., side by side. The boards may be hinged together by means of tape strips 20 or other suitable means to form a uinitary assembly. The pieces are arranged in the same fashion as for the first embodiment, with the pieces for one side being arranged in rows 11*a*, 11*b* and 12*a* and the pieces for the opposite side being arranged in rows 18*a*, 18*b* and 17*a*.

Referring now to FIG. 3, a third embodiment of the invention is shown. This embodiment is similar to the second in that the boards 11–18 are arranged adjacent to each other and joined together by hinges 20. However, in this embodiment, the hinges are elongated and the boards are in a stepped arrangement with adjacent boards being stepped vertically relative to each other. A brace 21 is attached to board 18 to provide support for the boards.

Conventional chess rules are followed with the proviso that pieces can only be moved either horizontally or vertically. With a vertical move, a sidewise move is permitted as in the case of a knight but not a fore or aft move. Any single move cannot be both up or down and fore or aft. To illustrate how moves can be made, the possible moves for knight 25 shown on board 15 in FIG. 2 are shown. The horizontal moves available on board 15, which are indicated by arrows, as can be seen, are the moves available in a conventional game of chess. The vertical moves available are shown on boards 13, 14, 16 and 17 by "x" marks.

The game is otherwise played according to the conventional rules of chess, with the same objectives in mind but with the "kings" rows for the two sides being on one side of the topmost board and the opposite side of the lowermost board respectively.

While the invention has been described and illustrated in detail, it is to be clearly understood that this is intended by way of illustration and example only and is not to be taken by way of limitation, the scope of the invention being limited only by the terms of the following claims:

I claim:

1. A method of enabling the playing of a three dimensional chess game comprising the steps of:

providing eight chess boards, each chess board surface being divided into a grid of eight by eight squares, each of said squares being colored with one of two different colors, the laterally and longitudinally adjacent squares being of different colors to form a checkerboard pattern, A first one of said boards representing a lowermost board, a second one of said boards representing a topmost board, the six other of said boards each representing a different successive vertical position between the topmost and lowermost boards, the corresponding corner squares of boards representing adjacent vertical positions being of different colors, arranging a first set of eight kings row chess pieces for one opposing playing side in the first row of squares on one side of the lowermost board, arranging a first set of eight pawn pieces for said one opposing playing side in the second row of squares on said one side of the lowermost board, arranging a second set of eight pawn pieces for said one opposing playing side in the first row of squares on the board representing the vertical position immediately above said lowermost board, said first row of squares being immediately above the kings row of pieces for said one playing side, arranging a second row of eight kings row pieces for the other opposing playing side in the first row of the topmost board one the side thereof opposite to that on which the first set of kings row pieces is arranged, arranging a first set of eight pawn pieces for the other opposing playing side on the topmost board in the second row of squares, adjacent to the kings row pieces for the other playing side, and arranging a second set of opposing pawn pieces for the other opposing playing side on the board representing the vertical position immediately below the topmost board in the first row of squares thereof immediately beneath the kings row pieces for the other playing side, the pieces being movable in the alternative either fore or aft horizontally or between boards representing vertical positions.

2. The method of claim 1 and additionally including the step of stacking the boards one above the other in tiers.

3. The method of claim 1 and additionally including the step of placing the boards in a flat side by side arrangement.

4. A three dimensional chess game comprising:

eight chess boards, each chess board surface being divided into a grid of eight by eight squares, each of said squares being colored with one of two different colors, the laterally and longitudinally adjacent squares being of different colors to form a checkerboard pattern, means for joining said boards together in an end to end linear arrangement, A first one of said boards representing a lowermost board, a second one of said boards representing a topmost board, the six other of said boards each representing a different successive vertical position between the topmost and lowermost boards, the corresponding corner squares of boards representing adjacent vertical positions being of different colors, a first set of eight kings row chess pieces for one opposing playing side arranged in the first row of squares on one side of the lowermost board, a first set of eight pawn pieces for said one opposing playing side arranged in the second row of squares on said one side of the lowermost board, a second set of eight pawn pieces for said one opposing playing side arranged in the first row of squares on the board representing the vertical position immediately above said lowermost board, said first row of squares being immediately above the kings row of pieces for said one playing side, a second row of eight kings row pieces for the other opposing playing side arranged in the first row of the topmost board on the side thereof opposite to that on which the first set of kings row pieces is arranged, a first set of eight pawn pieces for the other opposing playing side arranged on the topmost board in the second row of squares, adjacent to the kings row pieces for the other playing side, and a second set of opposing pawn pieces for the other opposing playing side arranged on the board representing the vertical position immediately below the topmost board in the first row of squares thereof immediately beneath the kings row pieces for the other playing side, the pieces being movable in the alternative either fore or aft horizontally or between boards representing vertical positions.

5. The chess game of claim 4 wherein the boards are in a stepped arrangement, each of said boards being located adjacent to another one of said boards, and means for joining said boards together with adjacent boards stepped vertically relative to each other.

6. The chess game of claim 4 wherein the boards are placed in a flat side by side arrangement.

* * * * *